US009898998B2

(12) United States Patent
Lee et al.

(10) Patent No.: US 9,898,998 B2
(45) Date of Patent: Feb. 20, 2018

(54) APPARATUS AND METHOD FOR GENERATING CORRECTION DATA, AND IMAGE QUALITY CORRECTION SYSTEM THEREOF

(71) Applicant: SAMSUNG ELECTRONICS CO., LTD., Suwon-si (KR)

(72) Inventors: Min-hoon Lee, Seoul (KR); Sang-hyoun Kim, Seoul (KR); Sung-soo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 14/554,468

(22) Filed: Nov. 26, 2014

(65) Prior Publication Data

US 2015/0145841 A1 May 28, 2015

(30) Foreign Application Priority Data

Nov. 28, 2013 (KR) ..... 10-2013-0146058
Apr. 11, 2014 (KR) ..... 10-2014-0043722

(51) Int. Cl.
*G09G 5/02* (2006.01)
*G09G 3/00* (2006.01)
*G09G 3/20* (2006.01)

(52) U.S. Cl.
CPC ..... *G09G 5/02* (2013.01); *G09G 3/006* (2013.01); *G09G 3/2003* (2013.01); (Continued)

(58) Field of Classification Search
CPC ..... G09G 3/006; G09G 2320/0285; G09G 2320/0242; G09G 2320/0233
See application file for complete search history.

(56) References Cited

U.S. PATENT DOCUMENTS 7,834,836 B2 * 11/2010 Chung ..... G09G 3/20 345/214
8,085,278 B2 12/2011 Hwang et al.
(Continued)

FOREIGN PATENT DOCUMENTS

JP 5174837 A 4/2013

OTHER PUBLICATIONS

Communication dated Oct. 28, 2015 issued by European Patent Office in counterpart European Patent Application No. 14194920.6.
(Continued)

*Primary Examiner* — Kwang-Su Yang
(74) *Attorney, Agent, or Firm* — Sughrue Mion, PLLC

(57) ABSTRACT

A correction data generating apparatus, a method of generating correction data, and an image quality correction system are provided. The method of generating correction data includes detecting brightness of a display panel, determining an non-uniform area of the display panel for each RGB color based on the detected brightness, generating correction data regarding the non-uniform area by determining a screen split size and a correction section for correcting an image quality of the display panel based on the non-uniform area, and storing the generated correction data. In this case, the correction data is stored in a storage of a display apparatus controlling the display panel, and the display apparatus corrects an image quality of the display panel using the correction data.

15 Claims, 13 Drawing Sheets

(52) U.S. Cl.
CPC ... *G09G 3/2007* (2013.01); *G09G 2320/0233* (2013.01); *G09G 2320/0242* (2013.01); *G09G 2320/0285* (2013.01); *G09G 2320/0693* (2013.01); *G09G 2360/145* (2013.01)

(56) References Cited

U.S. PATENT DOCUMENTS

| | | | | |
|---|---|---|---|---|
| 2007/0091042 | A1 | 4/2007 | Chung et al. | |
| 2008/0036703 | A1* | 2/2008 | Wang | G09G 3/006 345/76 |
| 2008/0049051 | A1 | 2/2008 | Han et al. | |
| 2008/0068324 | A1* | 3/2008 | Chung | G09G 3/006 345/98 |
| 2008/0205747 | A1* | 8/2008 | Kuchii | G06T 5/20 382/149 |
| 2013/0201180 | A1 | 8/2013 | Jeon et al. | |

OTHER PUBLICATIONS

Communication from the Korean Intellectual Property Office dated Mar. 20, 2015 in a counterpart Korean application No. 10-2014-0043722.

Communication dated Nov. 25, 2016, issued by European Patent Office in counterpart European Patent Application No. 14194920.6.

* cited by examiner

APPARATUS AND METHOD FOR GENERATING CORRECTION DATA, AND IMAGE QUALITY CORRECTION SYSTEM THEREOF

CROSS-REFERENCE TO RELATED APPLICATIONS

This application claims priority from Korean Patent Application No. 10-2013-0146058, filed in the Korean Intellectual Property Office on Nov. 28, 2013, and Korean Patent Application No. 10-2014-0043722, filed in the Korean Intellectual Property Office on Apr. 11, 2014, the entire disclosures of which are incorporated herein by reference in their entirety.

BACKGROUND

1. Field

Aspects of the exemplary embodiments relate to an apparatus and a method for generating correction data, and an image quality correction system thereof, and more particularly, to an apparatus and a method for generating correction data to correct the non-uniformity of a display panel, and an image quality correction system thereof.

2. Description of the Related Art

A display panel may have non-uniform image quality due to many factors that occur during the manufacturing process. For example, a specific area of the display panel may appear to be brighter or darker than other areas, or the color temperature of the display panel may be reddish or bluish overall.

In particular, as current display panels become larger and thinner, various types of non-uniform image quality occur. For example, non-uniformity of image quality may appear only in a specific gradation section or a specific area of the display panel.

In a related art display panel, the non-uniformity in the display panel can be corrected in a limited form with reference only to brightness, or only a predetermined gradation can be corrected. However, such a limited method of correction cannot be applied to a display panel which is provided in various types and colors. In addition, a panel for which a correction is applied in a limited manner or conversely, is applied in an excessive manner may occur, thereby affecting productivity of the panel.

SUMMARY

An aspect of the exemplary embodiments relates to an apparatus and a method of generating correction data to improve non-uniform image quality of a display panel by generating and providing correction data with respect to the non-uniform area of the display panel, and an image quality correction system thereof.

A method of generating correction data according to an exemplary embodiment, the method includes detecting brightness of a display panel of a display apparatus, determining a non-uniform area of the display panel for each red, green, and blue (RGB) color based on the detected brightness, generating correction data regarding the non-uniform area by determining a screen split size and a correction section for correcting an image quality of the display panel based on the non-uniform area, storing the generated correction data in a storage of the display apparatus, and correcting, by the display apparatus, an image quality of the display panel based on the correction data.

The generating may include determining whether to correct each RGB color based the non-uniform area determined for each RGB color.

The generating may include, when a correction for a plurality of colors is required, determining a correction section for each color where the correction is required.

The generating may further include calculating a correction value for each correction section based on the determined screen split size and generating correction data including the calculated correction value and correction information, and the correction information may include at least one of the correction section information, the information regarding whether to correct each RGB color, and the screen split size information.

The number of data of the correction data may be calculated by adding the number of correction value data and the number of correction information data.

The generating may include assigning a separate address so as to distinguish the correction section information, the information regarding whether to correct each RGB color, and the screen split size information from the calculated correction value.

The display apparatus may process the correction data using one of a timing controller, a frame rate controller, a scaler, and separate hardware.

A correction data generating apparatus according to an exemplary embodiment includes a detector configured to detect brightness of a display panel of a display apparatus, a determination device configured to determine a non-uniform area of the display panel for each RGB color based on the detected brightness, a correction data generator configured to generate correction data regarding the non-uniform area by determining a screen split size and a correction section for correcting an image quality of the display panel based on the non-uniform area, and a storage configured to store the generated correction data in a storage of the display apparatus, wherein the display apparatus corrects an image quality of the display panel based on the correction data.

The correction data generator is configured to determine whether to correct each RGB color based the non-uniform area determined for each RGB color.

The correction data generator is configured to determine a correction section for each color where the correction is required when a correction for a plurality of colors is required.

The correction data generator is configured to calculate a correction value for each correction section based on the determined screen split size, and generate correction data including the calculated correction value and correction information, and the correction information may include at least one of the correction section information, the information regarding whether to correct each RGB color, and the screen split size information.

The number of data of the correction data may be calculated by adding the number of correction value data and the number of correction information data.

The correction data generator may assign a separate address so as to distinguish the correction section information, the information regarding whether to correct each RGB color, and the screen split size information from the calculated correction value.

The display apparatus may process the correction data using one of a timing controller, a frame rate controller, a scaler, and separate hardware.

An image quality correction system according to an exemplary embodiment includes a correction data generating apparatus configured to detect brightness of a display panel, determine a non-uniform area of the display panel for each RGB color based on the detected brightness, determine a screen split size and a correction section to correct image quality of the display panel based on the non-uniform area, and generate correction data regarding the non-uniform area and a display apparatus configured to store the generated correction data and process an image of the non-uniform area from among input images based on the correction data.

BRIEF DESCRIPTION OF THE DRAWINGS

The above and/or other aspects of the present exemplary embodiments will be more apparent by describing certain exemplary embodiments with reference to the accompanying drawings, in which.

DETAILED DESCRIPTION OF THE EXEMPLARY EMBODIMENTS

Figure 1:
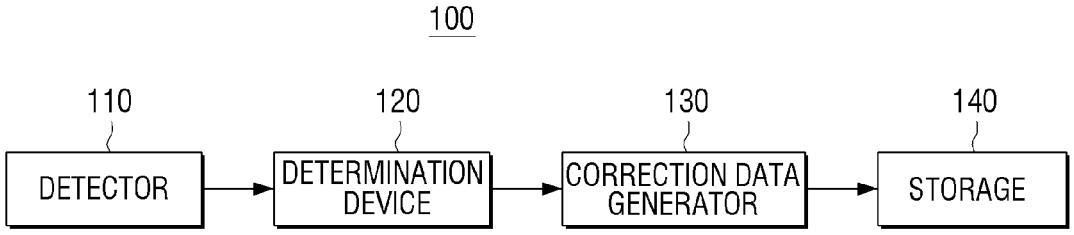
FIG. 1 is a block diagram illustrating configuration of a correction data generating apparatus briefly according to an exemplary embodiment.

Hereinafter, an exemplary embodiment will be described in detail with reference to accompanying drawings. In the following description, same reference numerals are used for analogous elements when they are depicted in different drawings. The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

In the present disclosure, relational terms such as first and second, and the like, may be used to distinguish one entity from another entity, without necessarily implying any actual relationship or order between such entities.

FIG. 1 is a block diagram illustrating the configuration of a correction data generating apparatus 100 according to an exemplary embodiment. As illustrated in FIG. 1, the correction data generating apparatus 100 includes a detector 110, a determination device 120, a correction data generator 130, and a storage 140.

The detector 110 detects brightness of a display panel included in a display apparatus. In particular, the detector 110 may detect brightness by changing an input image of a display panel from a low gradation to a high gradation or from a high gradation to a low gradation with reference to a white color. In addition, the detector 110 may detect brightness regarding an input image having a plurality of colors (for example, red, green, blue, etc.) of a display panel.

The determination device 120 may detect a non-uniform area of the display panel based on the detected brightness. In this case, the determination device 120 may determine a non-uniform area regarding a single color (for example, white), but this is only an example. The determination device 120 may determine a non-uniform area regarding each of a plurality of RGB colors.

Figure 2A:
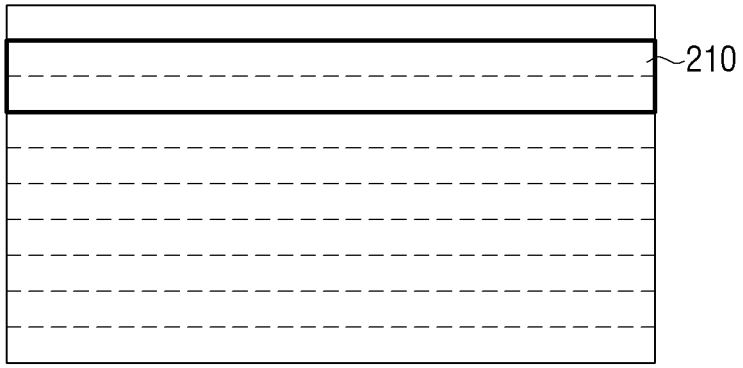
FIGS. 2A to 2D are views illustrating a non-uniform area of a display panel according to various exemplary embodiments.
Figure 2B:
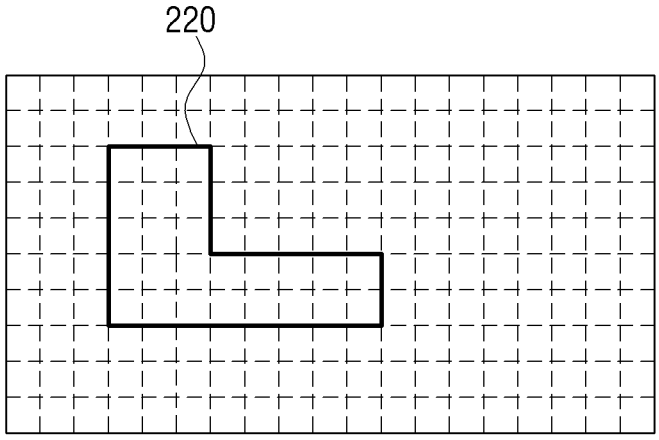
Figure 2C:
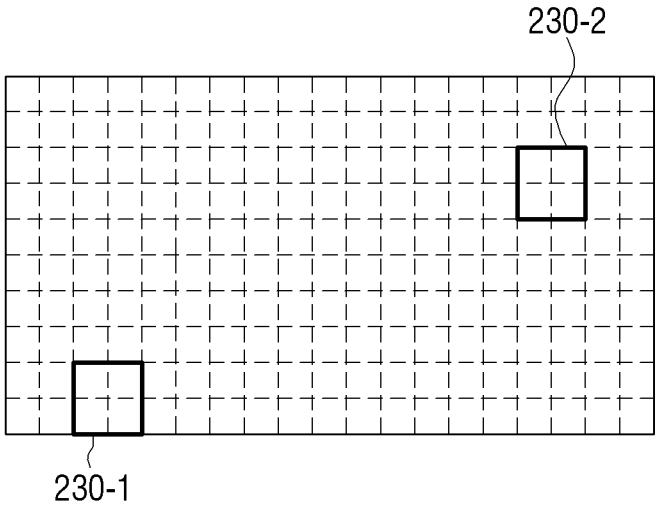
Figure 2D:
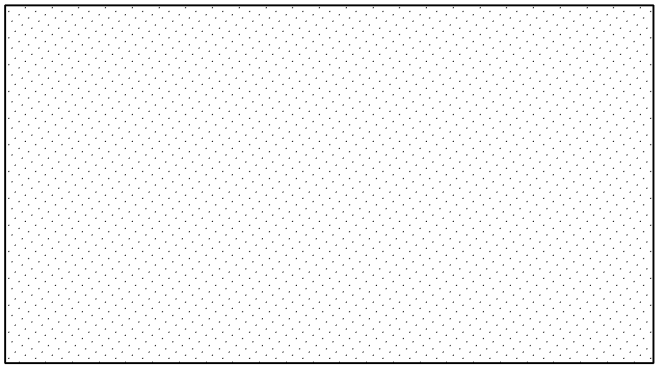

The non-uniform area of a display panel refers to an area where an image which is different from what is to be represented by the display panel is output. For example, the non-uniform area of a display panel may be a pixel line 210 which is output in different brightness from that of other pixel lines as illustrated in FIG. 2A. In another example, the non-uniform area of a display panel may be an area 220 in the form of a block in a longitudinal direction where an image is output in different brightness from that of pixels in other areas with respect to a specific color as illustrated in FIG. 2B. Alternatively, the non-uniform area of a display panel may be areas 230-1 and 230-2 in the form of block in a forward direction where an image is output in different brightness from that of pixels in other areas as illustrated in FIG. 2C. In this case, the first area 230-1 and the second area 230-2 may be non-uniform areas with respect to different colors. For example, the first area 230-1 may be n non-uniform area regarding green, and the second area 230-2 may be n non-uniform area regarding red. In another example, the non-uniform area of a display panel may be the entire area of a display panel of which color is inclined to a specific color (for example, red) as illustrated in FIG. 2D.

The correction data generator 130 generates correction data regarding the non-uniform area determined by the determination unit 120.

Specifically, the correction data generator 130 may determine whether to correct n non-uniform area for each of a plurality of colors. In this case, if a display panel outputs an image in a single color (for example, a white image), the correction data generator 130 may determine whether the display panel outputs colors other than the single color, and determine whether to make a correction for each of a plurality of colors. For example, if a display panel outputs a white image, the first area of the display panel outputs green color, and the second area of the display panel outputs red color, the correction data generator 130 may determine that a correction regarding the green color is required in the first area of the display panel, and a correction regarding the red color is required in the second area of the display panel.

In addition, if a display panel outputs each RGB image, the correction data generator 130 may determine whether a non-uniform area exists in the image where each color is output, and determine whether to make a correction for a plurality of colors. For example, if a display panel outputs a red image, and another color is output in the red image, the correction data generator 130 may determine that a correction is required.

Further, the correction data generator 130 may determine a screen split size for screen correction to improve the image quality of the display panel. Specifically, the correction data generator 130 may determine a screen split size based on the size and shape of a non-uniform area. More specifically, the correction data generator 130 may determine a maximum area where a non-uniform area can be divided as a screen split size. For example, as illustrated in FIG. 2B, if there is a non-uniform area 220, the correction data generator 130 may determine a (1×3) size as the screen split size for screen correction. In another example, as illustrated in FIG. 2C, if there are non-uniform areas 230-1, 230-2, the correction data generator 130 may determine a (2×2) size as the screen split size for screen correction. As described above, by determining a maximum area where a non-uniform area can be divided based on the size and shape of the non-uniform area as the screen split size for screen correction, correction data having the least amount of data can be generated.

The correction data generator 130 may also determine a correction section regarding a non-uniform area. In this case, the correction data generator 130 may determine a correction section having constant intervals. For example, the correction data generator 130 may determine a correction section having 8 sections with respect to 256 gradation. Alternatively, the correction data generator 130 may determine a correction section having inconsistent intervals. In this case, the correction data generator 130 may have a narrow correction section near the gradation where a non-uniform area occurs, and a wide correction section near the gradation where a non-uniform area does not occur. For example, if a non-uniform area occurs between 25 gradation and 230 gradation, the correction data generator 130 may set the intervals such that a narrow correction exists near 25 gradation and 230 gradation, and a wide correction section exists near the remaining gradations.

The correction data generator 130 may determine a correction value regarding a non-uniform area for each color and correction section. Specifically, if a correction regarding a single color is required, the correction data generator 130 may determine a correction value regarding a non-uniform area according to the correction section of the single color. For example, if a non-uniform area occurs in the second correction section (for example, 20 graduation~40 gradation) and the sixth correction section (for example, 100 gradation~120 gradation) with regard to a white image, the correction data generator 130 may determine a correction value regarding the second correction section and the sixth correction section.

If a correction with regard to a plurality of colors is required, the correction data generator 130 may determine a correction value regarding a non-uniform area according to the correction section for each color where a correction is required. For example, if a non-uniform area occurs in the first correction section (for example, 0 gradation~15 gradation) and the seventh correction section (205 gradation~215 gradation) with regard to a red image, and a non-uniform area occurs in the third correction section (55 gradation~70 gradation) with regard to a green image, the correction data generator 130 may determine a correction value with regard to the first correction and the seventh correction section of the red image, and determine a correction value with regard to the third correction section of the green image.

In particular, the correction data generator 130 may determine a correction value such that the brightness and color of a non-uniform area becomes the same as the brightness and color of other areas. For example, if the output brightness of a non-uniform area in the first correction section is higher than the general brightness, the correction data generator 130 may determine a correction value to lower the output brightness of the first correction section. In another example, if a non-uniform area of the second correction section with regard to a white image is output in red color, the correction data generator 130 may determine a correction value so that the second correction section regarding the white image is output in white color.

In addition, the correction data generator 130 determines whether an output screen is even by applying a correction value. If the screen output by applying a correction value is even, the correction data generator 130 may generate correction data including the correction value and correction information. In this case, the correction information may include at least one of a correction section, whether a correction is performed for each RGB color, and a screen split size. If the screen output by applying a correction value is not even, the correction data generator 130 may generate a correction value again by performing the above-described operations. In this case, the correction data generator 130 may repeat the above-described operations until an even screen is output.

The storage 140 stores generated correction data. In this case, the generated correction data may include a correction value and correction information as described above. Accordingly, the number of data stored in the correction data may be calculated by adding the number of correction value data and the number of correction information data.

In this case, the number of correction value data can be calculated by Equation 1 as shown below.

$$\left(\frac{(H_p \times V_p)}{(H_{blocksize} \times V_{blocksize})}\right) \times P_n \times R_{whether\ to\ connect} + \left(\frac{(H_p \times V_p)}{(H_{blocksize} \times V_{blocksize})}\right) \times P_n \times G_{whether\ to\ connect} + \left(\frac{(H_p \times V_p)}{(H_{blocksize} \times V_{blocksize})}\right) \times P_n \times B_{whether\ to\ connect} \quad \text{[Equation 1]}$$

In this case, Hp and Vp refer to the number of horizontal pixels and vertical pixels of the display panel, respectively, Hblocksize and Vblocksize refer to the number of horizontal pixels and vertical pixels of the screen split area for correction, Pn refers to the number of correction sections, and whether to $R_{correct}$, $G_{correct}$ and $B_{correct}$ may be whether to correct each RGB color.

The number of correction information data may be calculated by Equation 2 as shown below.

(Number of information of $H_{blocksize}$ and $V_{blocksize}$)+(Number of $R_{whether\ to\ correct}$, $G_{whether\ to\ correct}$ and $B_{whether\ to\ correct}$)+(Number of correction sections and Number of correction section information) [Equation 2]

In this case, the correction information data included in the correction data is stored in a predetermined specific address to be distinguished from the correction value data, and the number of correction data and the address for each correction section may be set to correspond to the correction information data.

As described above, the generated correction data may be stored in a display apparatus controlling the display panel, and the display apparatus may correct and output the RGB colors of an image using the correction data. In this case, the display apparatus may process correction data using one of a timing controller, a frame rate controller, a scaler, and separate hardware, which will be described with reference to FIGS. 3A to 3C.

Figure 3A:
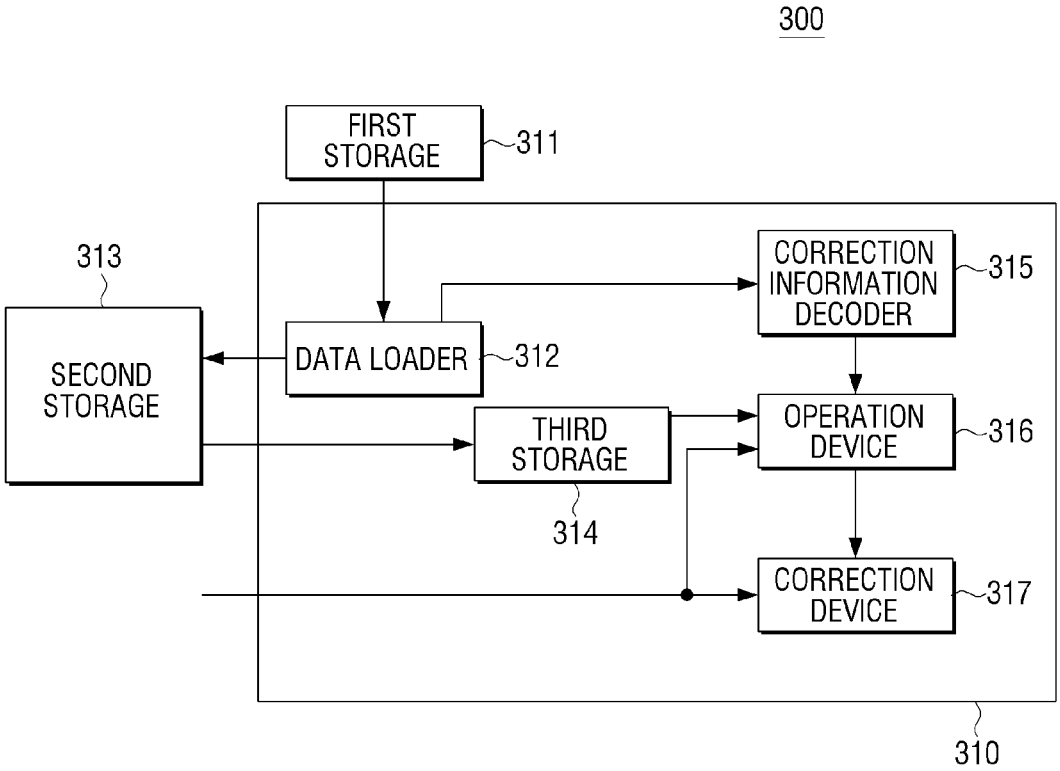
FIGS. 3A to 3C are views illustrating configuration of a display apparatus to correct an non-uniform area according to various exemplary embodiments.

FIG. 3A is a view provided to explain an exemplary embodiment where a timing controller processes correction data according to the first exemplary embodiment.

The first storage 311 stores correction data. In this case, the first storage 311 may be realized as a permanent storage apparatus. For example, the first storage 311 may be realized as one of a flash memory and EEPROM.

Figure 6A:
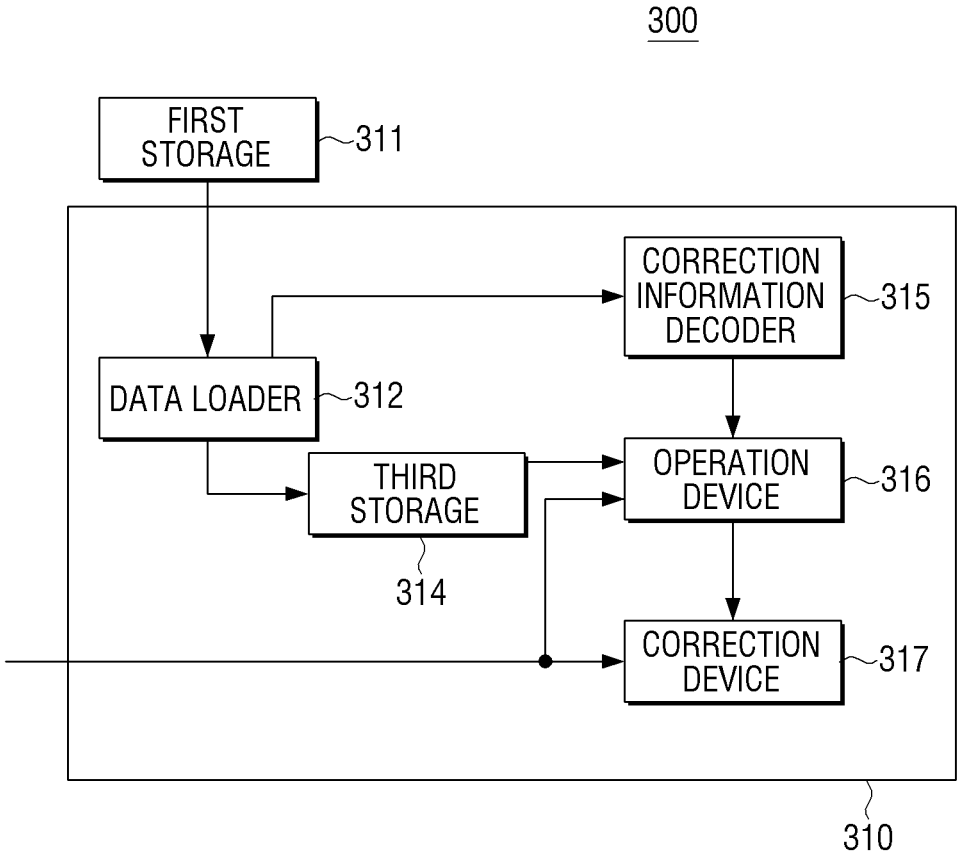
FIGS. 6A to 6C are views illustrating the configuration of a display apparatus to correct a non-uniform area according to other exemplary embodiments.

If the display apparatus 300 operates, a data loader 312 of a timing controller 310 may load correction data, and classify the correction data as correction value data and correction information data based on a predetermined address. In addition, the data loader 312 may output the correction value data to the second storage 313, and output the correction information data to a correction information decoder 315. The second storage 313 may be realized as a temporary storage apparatus. For example, the second storage 313 may be realized as double data rate synchronous (DDR) or EDRAM. The second storage 313 may output the correction value data to the third storage 314 which is a storage space for operation, prior to performing operation of correction coefficient. However, as described above, the feature that the correction value data is stored in the second storage 313 temporarily and then, output to the third storage 314 is only an example. As illustrated in FIG. 6A, the correction value data may be output to the third storage 314 directly from the data loader 312. In addition, the correction information decoder 315 may decode the correction information data, and output information regarding a correction section, information regarding whether to make a correction for each RGB color, and information regarding a screen split size to an operation unit 316.

The operation device 316 included in the timing controller 310 may calculate a correction coefficient regarding a non-uniform area using the correction value data output from the third storage 314, information regarding the correction section output from the correction information decoder 315, information regarding whether to make a correction for each RGB color, and information regarding the screen split size for correction.

A correction device 317 included in the timing controller 310 performs a correction job using the correction coefficient calculated by the operation device 316 and the RGB data processed by an external image processor. The timing controller 310 may output image data using the corrected RGB data.

Figure 3B:
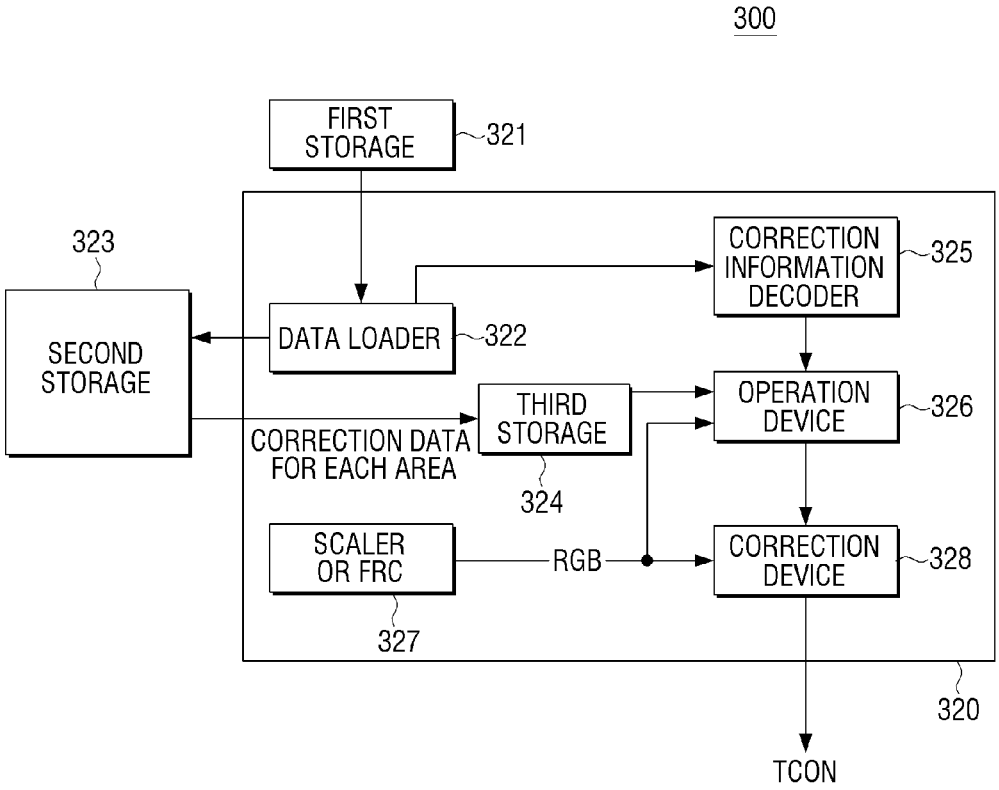

FIG. 3B is a view provided to explain an exemplary embodiment where the image processor 320 processes correction data according to the second exemplary embodiment. In this case, the image processor 320 may be an apparatus for image-processing, such as a Frame Rate Controller (FRC) or a scaler.

The first storage 321 stores correction data. In this case, the first storage 321 may be realized as a permanent storage apparatus. For example, the first storage 321 may be realized as one of a flash memory and EEPROM.

Figure 6B:
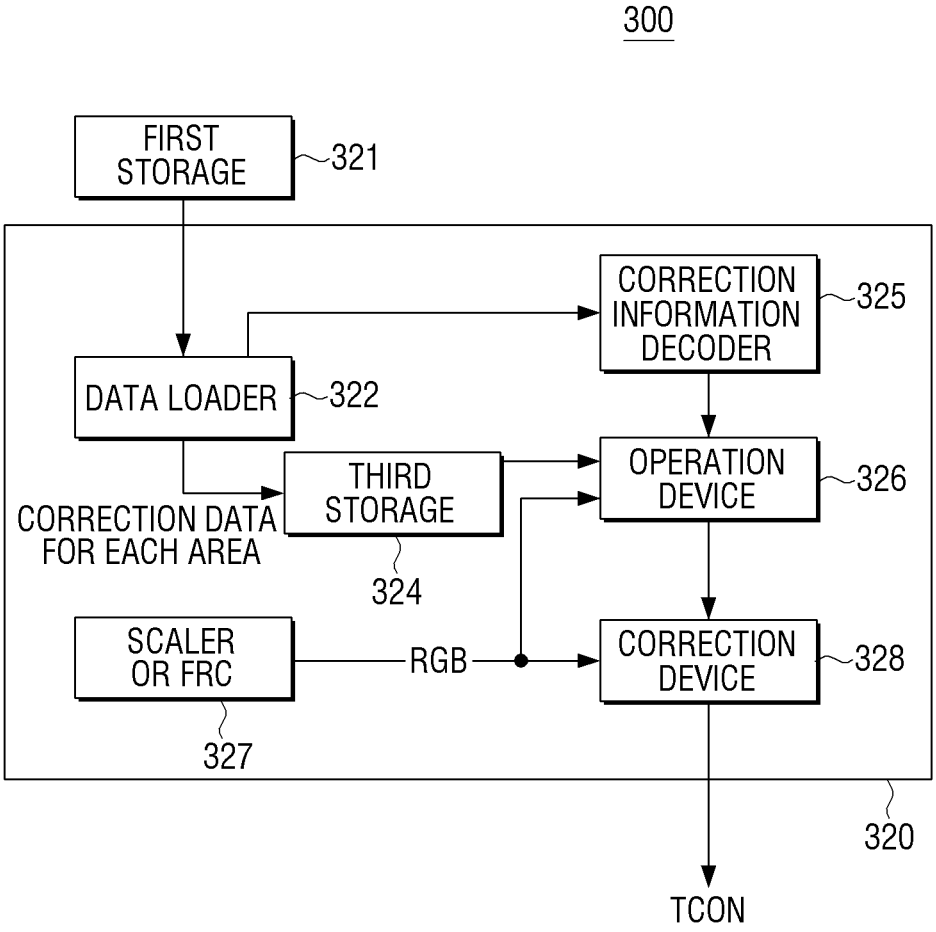

Once the display apparatus 300 operates, a data loader 322 of the image processor 320 may load correction data and classify it into correction value data and correction information data based on a predetermined address. In addition, the data loader 322 may output the correction value data to the second storage 323, and output the correction information data to a correction information decoder 325. The second storage 323 may be realized as a temporary storage apparatus. For example, the second storage 323 may be realized as DDR or EDRAM. The second storage 323 may output the correction value data to the third storage 324 which is a storage space for operation prior to performing an operation of a correction coefficient. However, as described above, the feature of storing the correction value data in the second storage 323 temporarily and outputting the data to the third storage 324 is only an example. As illustrated in FIG. 6B, the correction value data may be output to the third storage 324 directly from the data loader 322. The correction information decoder 325 may decode the correction information data and output information regarding a correction section, information regarding whether to make a correction for each RGB color, and information regarding a screen split size for correction to an operation device 326, respectively.

The operation device 326 included in the image processor 320 may calculate a correction coefficient regarding an non-uniform area by using the correction value data output from the third storage 324, information regarding a correction section output from the correction information decoder 325, information regarding whether to make a correction for each RGB color, and information regarding a screen split size for correction.

A correction device included in the image processor 320 performs a correction by using the correction coefficient calculated by the operation device 325 and the input RGB data. The image processor 320 may output the corrected RGB data to a timing controller.

Figure 3C:
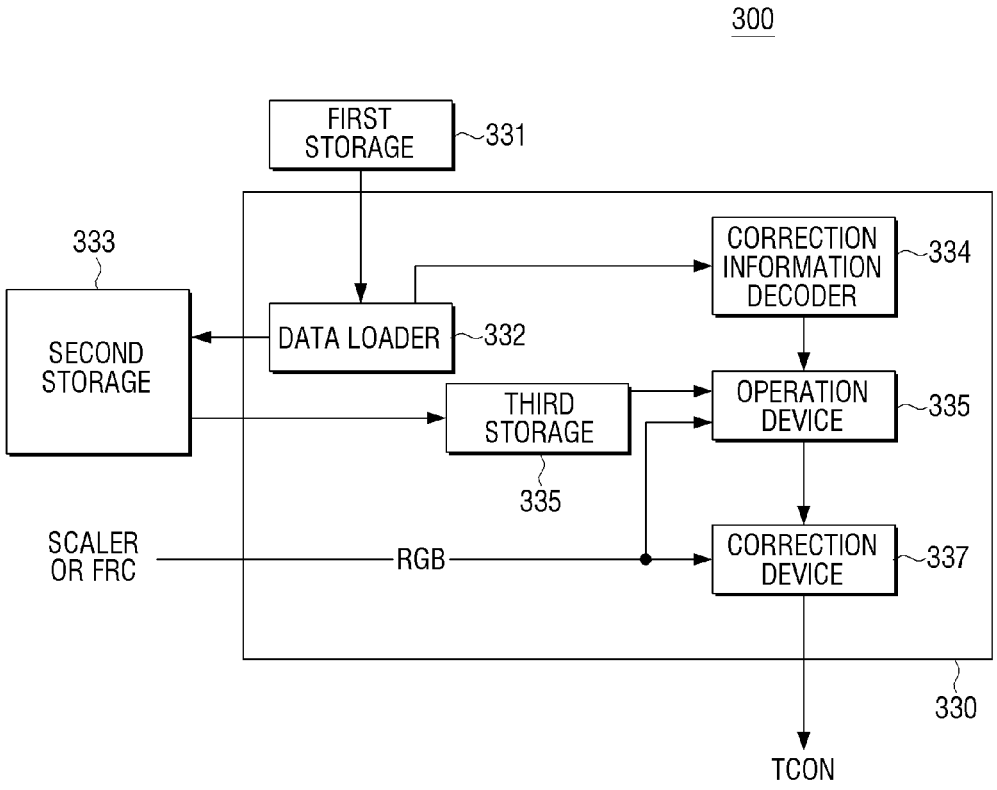

FIG. 3C is a view provided to explain an exemplary embodiment where separate hardware 330 for color correction processes correction data according to the third exemplary embodiment.

The first storage 331 stores correction data. In this case, the first storage 331 may be realized as a permanent storage apparatus. For example, the first storage 331 may be realized as one of a flash memory and EEPROM.

Figure 6C:
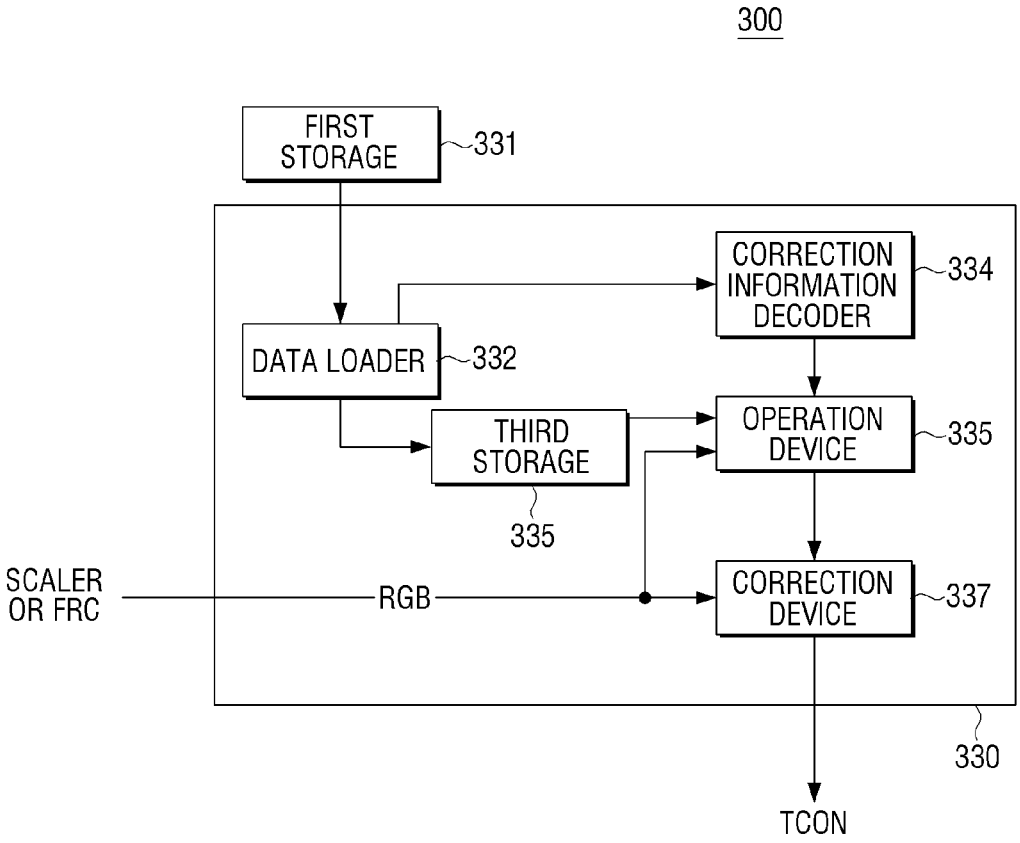

Once the display apparatus 300 operates, a data loader 332 of the color correction hardware may load correction data and classify the data into correction value data and correction information data based on a predetermined address. In addition, the data loader 332 may output the correction value data to the second storage 333, and output the correction information data to the correction information decoder 334. The second storage 333 may be realized as a temporary storage apparatus. For example, the second storage 333 may be realized as DDR or EDRAM. The second storage 333 may output correction value data to the third storage 335 which is a storage space for operation prior to performing an operation of a correction coefficient. However, as described above, the feature of storing the correction value data in the second storage 333 temporarily and outputting the data to the third storage 335 is only an example. As illustrated in FIG. 6C, the correction value data may be output to the third storage 335 directly from the data loader 332. The correction information decoder 334 may decode the correction information data and output information regarding a correction section, information regarding whether to make a correction for each RGB color, and information regarding a screen split size for correction to the operation device 336, respectively.

The operation device 336 included in the color correction hardware 330 may calculate a correction coefficient regarding a non-uniform area by using the correction value data output from the third storage 335, information regarding a correction section output from the correction information decoder 334, and information regarding whether to make a correction for each RGB color, and information regarding a screen split size for correction.

A correction device 337 included in the color correction hardware 330 performs a correction by using the correction coefficient calculated by the operation device 336 and the RGB data input from an image processor (for example, FRC or a scaler). The color correction hardware 330 may output the corrected RGB data to a timing controller.

As described above, according to various exemplary embodiments, the display apparatus 300 may perform a color correction regarding a non-uniform area.

Figure 4:
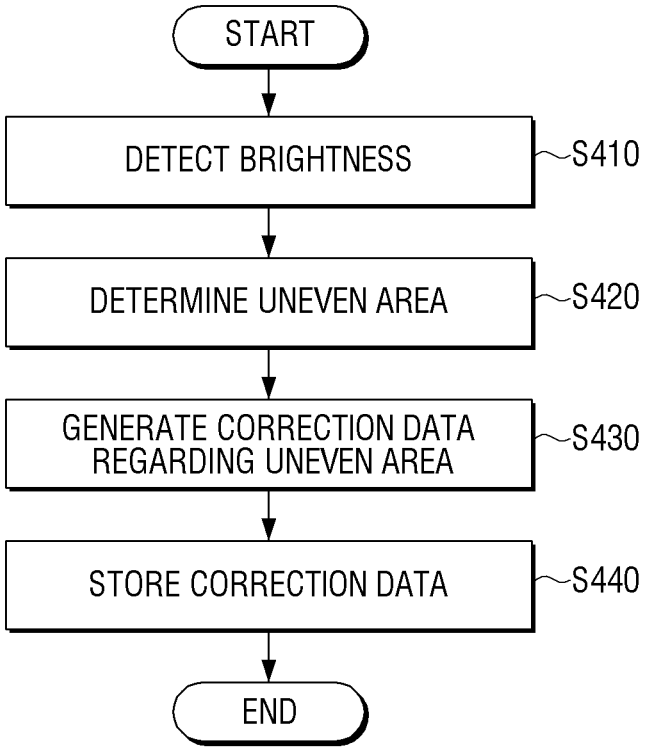
FIG. 4 is a flowchart provided to explain a method of generating correction data according to an exemplary embodiment.
Figure 5:
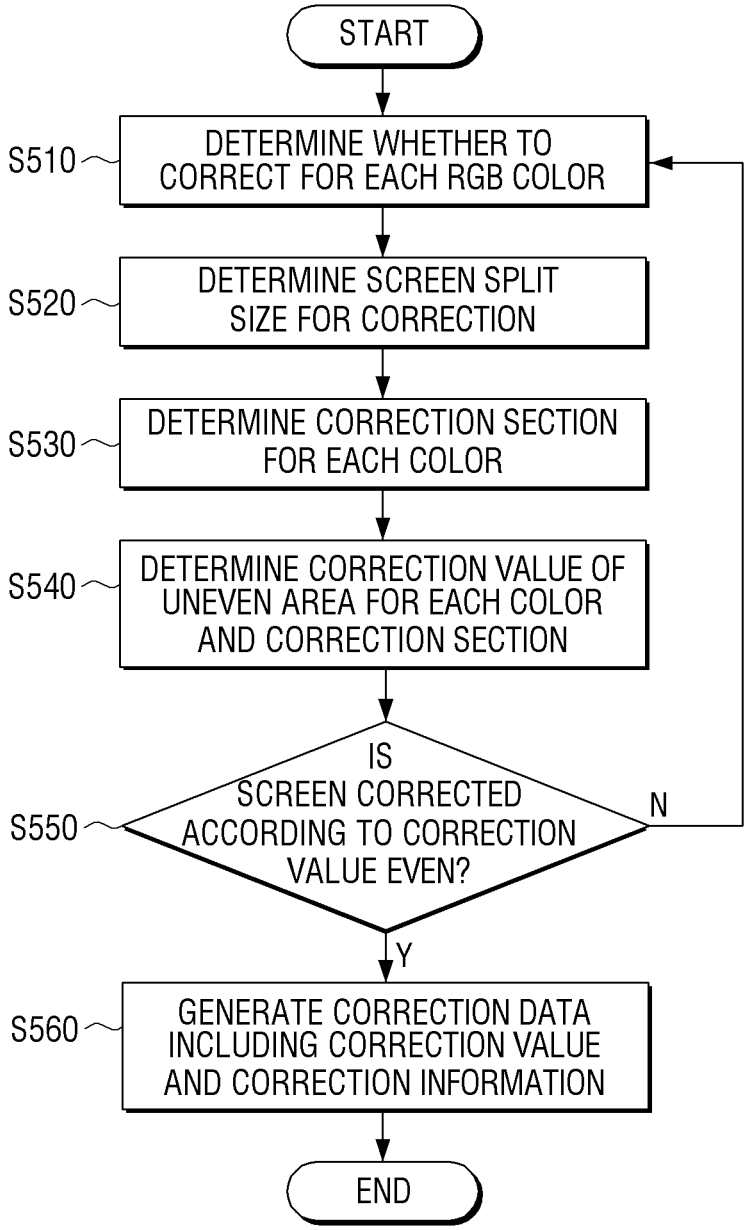
FIG. 5 is a flowchart provided to explain a method of generating correction data regarding an non-uniform area in detail according to an exemplary embodiment.

Hereinafter, the method of generating correction data will be described with reference to FIGS. 4 and 5. FIG. 4 is a flowchart provided to explain a method of generating correction data according to an exemplary embodiment.

First of all, the correction data generating apparatus 100 detects brightness of a display panel (operation S410). Specifically, the correction data generating apparatus 100 may detect the brightness by varying an input image of the display panel from low gradation to high gradation or from high graduation to low gradation with reference to a white color. In addition, the correction data generating apparatus 100 may detect brightness regarding an input image having a plurality of colors (for example, red, green, blue, etc.) of the display panel.

Subsequently, the correction data generating apparatus 100 determines a non-uniform area based on the detected brightness (operation S420). In this case, the correction data generating apparatus 100 may determine a non-uniform area with regard to a single color (for example, white), but this is only an example. The correction data generating apparatus 100 may determine a non-uniform area with regard to each of the plurality of RGB colors.

The correction data generating apparatus 100 generates correction data regarding a non-uniform area (operation S430), which will be described with reference to FIG. 5.

First of all, the correction data generating apparatus 100 determines whether to make a correction for each RGB color (operation S510).

Subsequently, the correction data generating apparatus 100 determines a screen split size for correction (operation S520). In this case, the correction data generating apparatus 100 may determine a screen split size for correction to be a maximum size in which an non-uniform area is divided based on the size and shape of the non-uniform area.

The correction data generating apparatus 100 determines a correction section for each color (operation S530). In this case, the correction data generating apparatus 100 may determine a correction section based on the number of gradation where a non-uniform area occurs.

Subsequently, the correction data generating apparatus 100 determines a correction value of a non-uniform area for each color and correction section (operation S540).

In addition, the correction data generating apparatus 100 determines again whether the display panel screen which is corrected according to the correction value is even (operation S550).

If the corrected screen is even (operation S550-Y), the correction data generating apparatus 100 generates correction data including a correction value and correction information (operation S560). In this case, the correction information may include information regarding whether a correction is performed for each RGB color, information regarding a screen split size for correction, and information regarding a correction section. If the corrected screen is not even (operation S550-N), the correction data generating apparatus 100 may go back to operation S510 and perform a correction again.

Referring back to FIG. 4, the correction data generating apparatus 100 stores the generated correction data (operation S440).

Accordingly, the evenness of the image quality of the display panel can be improved and thus, even image quality can be achieved in any area of the display panel. In addition, a correction method can be determined in consideration of the characteristics of the display panel, thereby reducing the time for generating data for correction and thus, minimizing the production cost.

A program code for performing a correction data generating method according to the above-described various exemplary embodiments can be stored in a non-transitory computer readable medium. The non-transitory computer readable medium refers to a medium which may store data semi-permanently rather than storing data for a short time such as a register, a cache, and a memory and may be readable by an apparatus. Specifically, the non-transitory recordable medium may be CD, DVD, hard disk, Blu-ray disk, USB, memory card, ROM, etc.

The foregoing exemplary embodiments are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method of generating correction data, the method comprising:

detecting brightness of a display panel of a display apparatus;

determining a non-uniform area of the display panel for each of red, green, and blue (RGB) colors based on the detected brightness;

determining, as a screen split size of the display panel, a size of an area of the display panel where the non-uniform area can be divided, and determining a correction section of the display panel based on the non-uniform area;

generating correction data regarding the non-uniform area based on the determined screen split size of the display panel and the determined correction section of the display panel for correcting an image quality of the display panel; and storing the generated correction data, wherein the correction data is stored in a storage of the display apparatus, and the display apparatus corrects an image quality of the display panel based on the correction data, and wherein the screen split size of the display panel is determined to be a maximum area in which the non-uniform area is divided based on a size and shape of the non-uniform area.

2. The method as claimed in claim 1, wherein the generating comprises determining whether to correct the each RGB color based on the non-uniform area determined for each RGB color.

3. The method as claimed in claim 2, wherein the determining the correction section comprises, when a correction for a plurality of colors is required, determining a correction section for each color where the correction is required.

4. The method as claimed in claim 3, wherein the generating further comprises:

calculating a correction value for each correction section for each of the RGB colors based on the determined screen split size; and generating correction data comprising the calculated correction value and correction information, wherein the correction information comprises at least one of information of the correction section, information regarding whether to correct each of the RGB colors, and information of the screen split size.

5. The method as claimed in claim 4, wherein an amount of the correction data is calculated by adding an amount of correction value data and an amount of correction information data.

6. The method as claimed in claim 4, wherein the generating comprises assigning a separate address to distinguish the information of the correction section, the information regarding whether to correct each of the RGB colors, and the information of the screen split size from the calculated correction value.

7. The method as claimed in claim 1, wherein the display apparatus processes the correction data based on one of a timing controller, a frame rate controller, a scaler, and separate hardware.

8. A correction data generating apparatus, comprising:

a storage;

a sensor to detect brightness of a display panel of a display apparatus; and a processor configured to:

determine a non-uniform area of the display panel for each of red, green, and blue (RGB) colors based on the detected brightness;

determine, as a screen split size of the display panel, a size of an area of the display panel where the non-uniform area can be divided, determine a correction section based on the non-uniform area and generate correction data regarding the non-uniform area based on the determined screen split size and the determined correction section for correcting an image quality of the display panel; and store the generated correction data in the storage, wherein the correction data is stored in a storage of the display apparatus, and the display apparatus corrects an image quality of the display panel based on the correction data, and wherein the screen split size of the display panel is determined to be a maximum area in which the non-uniform area is divided based on a size and shape of the non-uniform area.

9. The apparatus as claimed in claim 8, wherein the processor determines whether to correct each RGB color based the non-uniform area determined for each RGB color.

10. The apparatus as claimed in claim 9, wherein the processor, when a correction for a plurality of colors is required, determines a correction section for each color where the correction is required.

11. The apparatus as claimed in claim 10, wherein the processor is further configured to calculate a correction value for each correction section for each color based on the determined screen split size, and generate correction data comprising the calculated correction value and correction information, and wherein the correction information includes at least one of information of the correction section, the information regarding whether to correct each of the RGB colors, and information of the screen split size.

12. The apparatus as claimed in claim 11, wherein an amount of data of the correction data is calculated by adding an amount of correction value data and an amount of correction information data.

13. The apparatus as claimed in claim 11, wherein the processor is further configured to assign a separate address to distinguish the information of the correction section, the information regarding whether to correct each of the RGB colors, and the information of the screen split size from the calculated correction value.

14. The apparatus as claimed in claim 8, wherein the display apparatus processes the correction data based on one of a timing controller, a frame rate controller, a scaler, and separate hardware.

15. An image quality correction system, comprising:

a device configured to detect a brightness of a display panel, determine a non-uniform area of the display panel for each of red, green, and blue (RGB) colors based on the detected brightness, determine, as a screen split size of the display panel, a size of an area of the display panel where the non-uniform area can be divided, determine a correction section based on the non-uniform area to correct image quality of the display panel, and generate correction data regarding the non-uniform area based on the determined screen split size and the determined correction section; and a display apparatus configured to store the generated correction data and process an image of the non-uniform area from among input images based on the correction data, wherein the screen split size of the display panel is determined to be a maximum area in which the non-uniform area is divided based on a size and shape of the non-uniform area.

* * * * *